US010196829B2

(12) United States Patent
Fredenburg et al.

(10) Patent No.: US 10,196,829 B2
(45) Date of Patent: Feb. 5, 2019

(54) MOLDING/TRIM CONCEALED SLIDE-ON SYSTEM

(71) Applicants: Randall Roy Fredenburg, Mount Vernon, OH (US); Susan Eva Fredenburg, Mount Vernon, OH (US)

(72) Inventors: Randall Roy Fredenburg, Mount Vernon, OH (US); Susan Eva Fredenburg, Mount Vernon, OH (US)

( * ) Notice: Subject to any disclaimer, the term of this patent is extended or adjusted under 35 U.S.C. 154(b) by 0 days.

(21) Appl. No.: 14/752,869

(22) Filed: Jun. 27, 2015

(65) Prior Publication Data

US 2017/0051516 A1 Feb. 23, 2017

(51) Int. Cl.

| | |
|---|---|
| ***E04F 19/02*** | (2006.01) |
| ***E04F 19/06*** | (2006.01) |
| *E04C 2/40* | (2006.01) |
| *E04F 19/04* | (2006.01) |

(52) U.S. Cl.

CPC ..... *E04F 19/02* (2013.01); *E04F 19/06* (2013.01); *E04C 2/40* (2013.01); *E04F 19/0468* (2013.01); *E04F 19/065* (2013.01)

(58) Field of Classification Search

CPC ... E04F 19/02; E04F 19/0459; E04F 19/0463; E04F 19/0468; E04F 19/0038; E04F 19/06; E04F 19/065; E04F 19/067; E04C 5/2016; E04C 5/205; E04C 2/201

USPC ..... 52/203, 127.7, 127.1, 127.8, 506.01, 52/506.05, 507, 509, 511, 510, DIG. 1, 52/749.1, 749.11, 202

See application file for complete search history.

(56) References Cited

U.S. PATENT DOCUMENTS

| | | | | | |
|---|---|---|---|---|---|
| 2,082,668 | A * | 6/1937 | Vanderveld | A47F 3/00 | 411/352 |
| 2,525,204 | A * | 10/1950 | Calabro | B27D 3/00 | 100/214 |
| 3,230,652 | A * | 1/1966 | McNair | G09F 7/08 | 40/618 |
| 3,508,371 | A * | 4/1970 | Meyer | F16B 5/0642 | 24/295 |
| 3,535,846 | A * | 10/1970 | Storch | E04B 2/58 | 52/489.1 |
| 3,681,885 | A * | 8/1972 | Goggins | E04F 13/0801 | 52/288.1 |
| 3,903,670 | A * | 9/1975 | Robinson, Jr. | E04F 13/0821 | 52/478 |

(Continued)

*Primary Examiner* — Phi D A

(74) *Attorney, Agent, or Firm* — Frank H. Foster; Kremblas & Foster

(57) ABSTRACT

A concealed slide-on trim attachment method reduces the work effort and materials involved to refinish walls, ceilings, or anywhere trim is attached on a building using the conventional nailing method. When removing the existing trim, this invention eliminates the damage to the trim, walls, and ceilings, along with the issues previously associated with the current fastening process. With this invention, refinishing or renovation of the trim, walls, ceilings or any other associated building components can be completed without damage to surrounding surfaces or the existing trim, making the trim reusable. This is a simple way to attach and detach the trim when compared to the current nailing method or use of other fasteners. During initial construction, this invention may also reduce time and man-hours required for installation.

3 Claims, 9 Drawing Sheets

(56) References Cited

U.S. PATENT DOCUMENTS

| | | | | | |
|---|---|---|---|---|---|
| 3,990,199 | A * | 11/1976 | Gallo | E04H 13/006 | 52/126.4 |
| 4,408,372 | A * | 10/1983 | Kimura | F16B 21/073 | 24/662 |
| 5,125,197 | A * | 6/1992 | Fuchs | F24F 13/20 | 312/100 |
| 5,191,718 | A * | 3/1993 | Fox | E04C 1/42 | 249/214 |
| 5,467,571 | A * | 11/1995 | Khatibi | E04F 19/0463 | 403/388 |
| 5,752,356 | A * | 5/1998 | Miklavic | A47B 95/043 | 52/288.1 |
| 5,941,046 | A * | 8/1999 | Prather | E04F 19/0495 | 52/208 |
| 6,367,227 | B1 * | 4/2002 | Veyna | E04F 19/00 | 33/410 |
| 6,935,083 | B2 * | 8/2005 | Chezum | E04B 1/34342 | 52/391 |
| 7,647,732 | B2 * | 1/2010 | Rickards | E04F 13/0839 | 52/137 |
| 8,863,470 | B2 * | 10/2014 | Bottorff | E04F 21/0069 | 52/718.02 |

* cited by examiner (SHORT SCREW)

MOLDING/TRIM CONCEALED SLIDE-ON SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention addresses the methods and devices in buildings for attachment and removal of the trim found both internally and externally such as, but not limited to, windows, doors, ceiling trim, and baseboard. The benefits of refinishing or renovation of walls, ceilings, surrounding areas, or the trim without damage from removal is the prime motivation of the present invention.

The molding or trim has historically been attached to buildings by use of nails or other hard fasteners and has remained in use through modern time. For renovation, remodeling, or refinishing, the permanence of these methods requires a significant amount of time, effort, and expense to remove resulting in damage to the trim and the surrounding surfaces. Unless the trim is removed, or at least loosened, a simple task such as repainting an adjacent surface would result in uneven lines between the trim and the surface, with the paint either not meeting the trim or overlapping the trim. If removal is done several times, the trim would require replacement due to damage incurred from multiple removal attempts and the adjacent surfaces would have to be patched several times, possibly in multiple places, or the entire surface would have to be replaced.

Over the years, many tools have been developed to address these issues but none have remained in the marketplace simply because they did not work well enough. Some have worked better than others, such as masking tape but it too has it's issues. Straight lines between the trim and the adjacent surface is strictly dependent upon the individual applying the tape. Once used, the tape then has to be removed and disposed of, this is added cost and time.

As detailed above, there is a need for a simple method of attachment and removal that securely mounts the trim to the adjacent surface.

BRIEF SUMMARY OF THE INVENTION

This invention utilizes a thin foundation strip attached to the mounting surface of the building. The foundation strip is available for anyone to use for proper alignment of the attaching screw or rivet heads. These screw or rivet heads will be placed at 8 inch intervals through holes in the strip, attached securely, and the strip will mount to the building surface so as to locate the screw or rivet heads to a predetermined height. The 8 inch intervals are predetermined for secure attachment of the trim to the foundation strip. On the backside of the trim are keyhole mounting slots aligned with the spacing of the screw or rivet heads protruding from the foundation strip. The entire length of the trim is to be placed over the foundation strip with the large holes accepting the screw or rivet heads and then the trim can be slid into place to securely locate the trim. This will be repeated until all the trim is positioned along the base of the wall, around windows, doors, and for chair rails. For trim where there are four pieces to be attached to a surface, such as around a window, if each piece has a 45 degree angle cut to mate with the associated trim, one trim piece must have the capability of being placed over and pushed downward onto the mounting screws to lock the other three trim pieces into position. For ease of attachment, this piece should be the top trim piece and attached in a downward motion, moving towards the window, so that children cannot easily remove the trim from it's mounted position. The other three pieces should be attached by moving the trim downwards, beginning with the bottom piece and then each side sliding downwards so that the 45 degree angle on the ends mate to the already attached piece(s). If a side trim piece is to be mounted close to another wall, a low ceiling, or something protruding from the wall, then this piece can be designed to push onto the foundation strip from the window outwards. This makes it impossible to attach components as previously described. The above described method is the recommended method but mounting versatility is available for all potentialities.

Removal of the trim is simply performed by reversing the attachment method described above. Push any trim piece so that the large keyhole holes are positioned over the screw or rivet heads in the foundation strip and lift off.

A better understanding of this invention, along with the advantages, features, and aspects it offers, will become obvious when viewing the drawings that follow, along with each description and listed claims.

BRIEF DESCRIPTION OF THE SEVERAL VIEWS OF THE DRAWING(S)

FIG. 1: An exploded view of the keyhole quick release trim identifying each component and the location relationship of each with each item defined with a number, 1 through 7, inside a balloon, with a leader line from the item to the balloon, and each item is listed here.

FIG. 2: A detailed view of Item 1, the Trim, from FIG. 1 with the Trim prepared to receive Item 2, Item 6, or Item 7, the Keyhole Clip or Strip.

FIG. 3: This is a detailed, exploded view of Item 2, the Keyhole Clip, and how it mounts to the underside of Item 1, the Trim.

Figure 1:
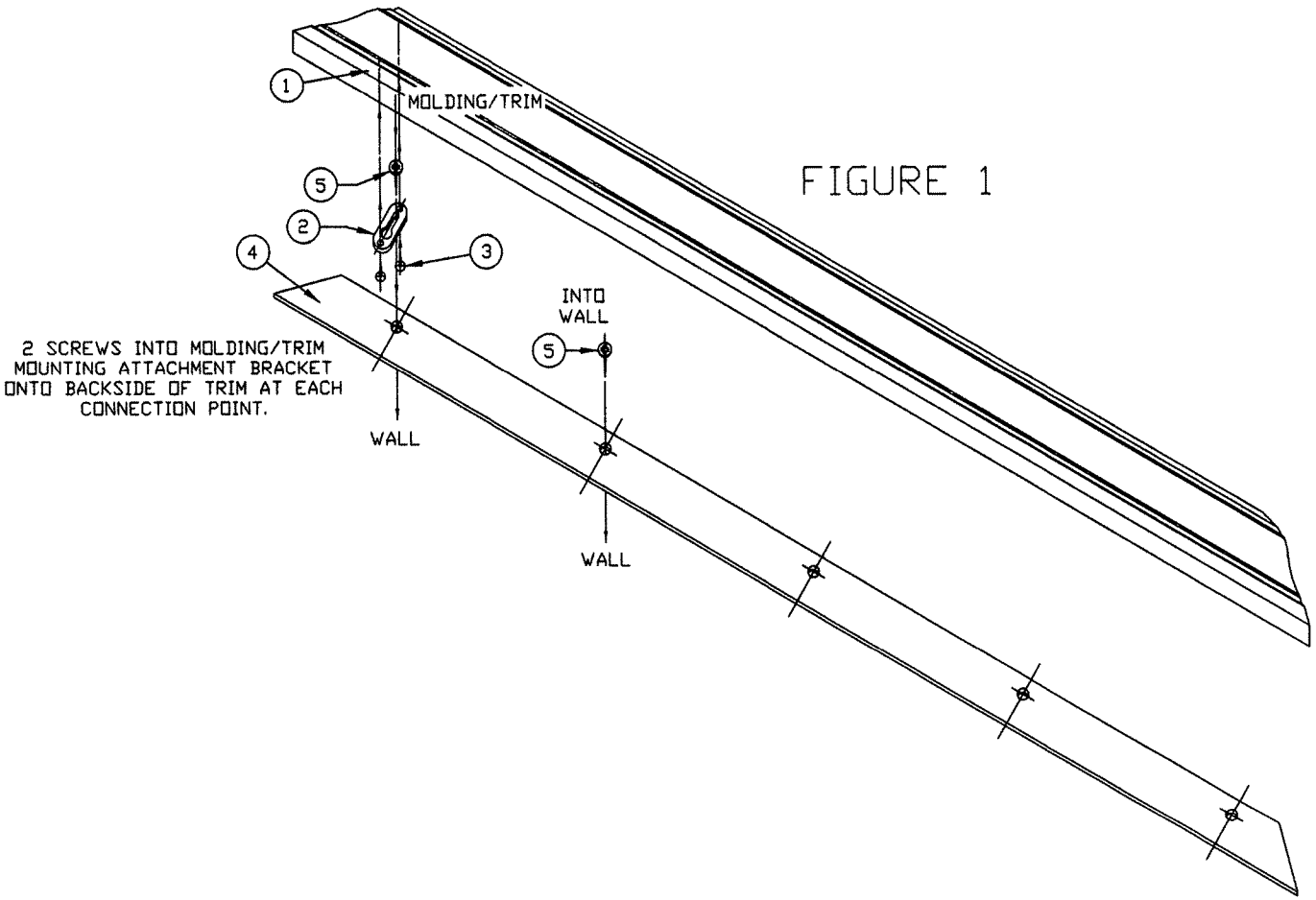
Figure 2:
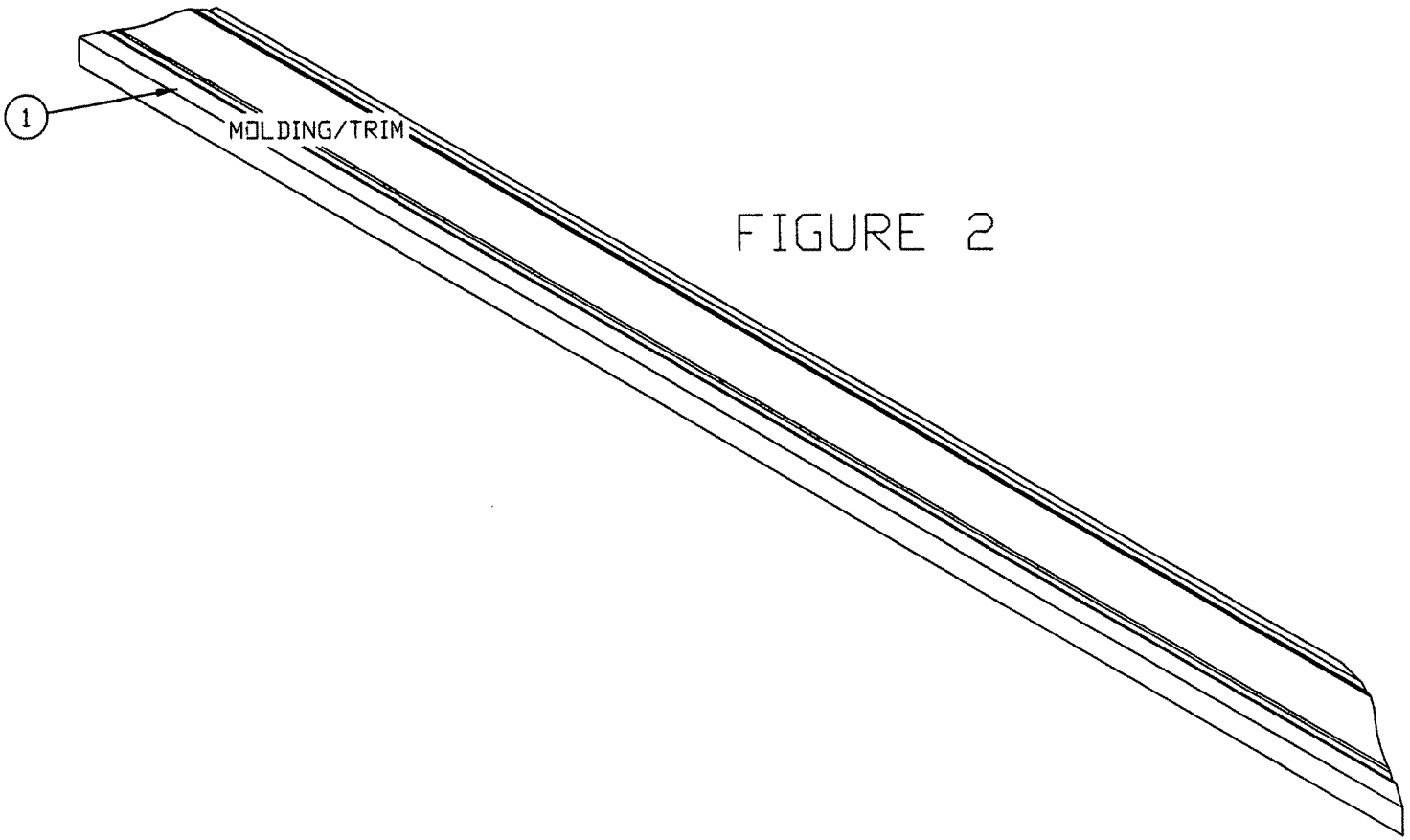
Figure 3:
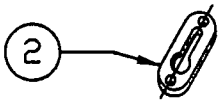
Figure 4:
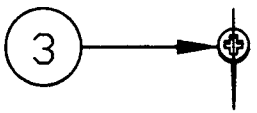
FIG. 4 is a detailed, exploded view of Item 3, two (2) Small Wood Screws, being utilized to attach the Item 2 or Item 6 and 7 to the underside of Item 1, the Trim.
Figure 5:
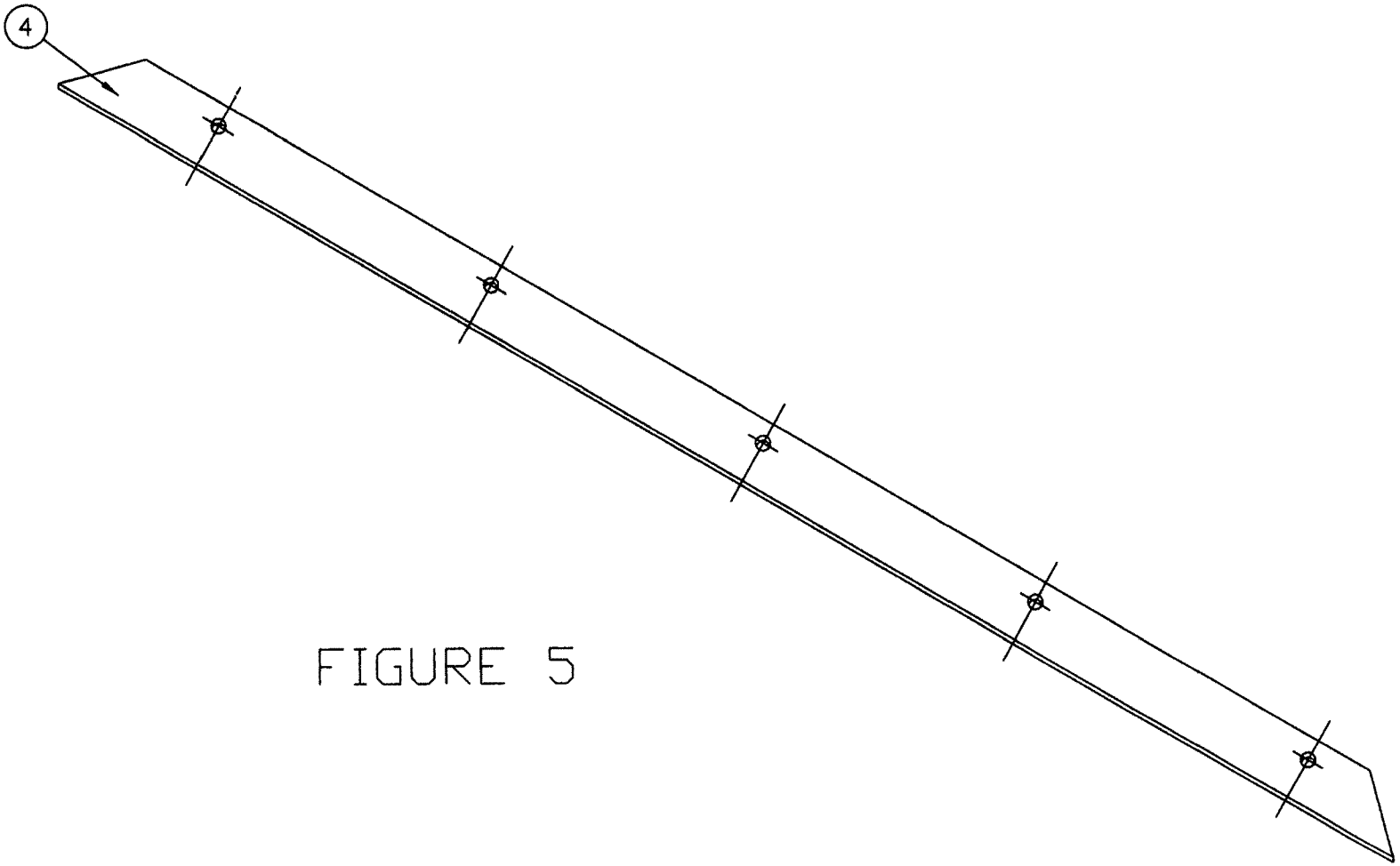
FIG. 5 is a detailed, exploded view of the Foundation Strip, Item 4, and placement for easy alignment of the Trim to the area for which it will be utilized.
Figure 6:
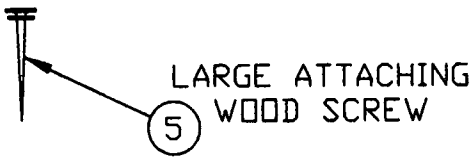

FIG. 6: This is a detailed, exploded view of Item 5, the Large Attaching Wood Screws, showing how these screws attach the Foundation Strip and how the heads will be used to anchor the trim through the Keyhole Clip or Strip.

Figure 7:
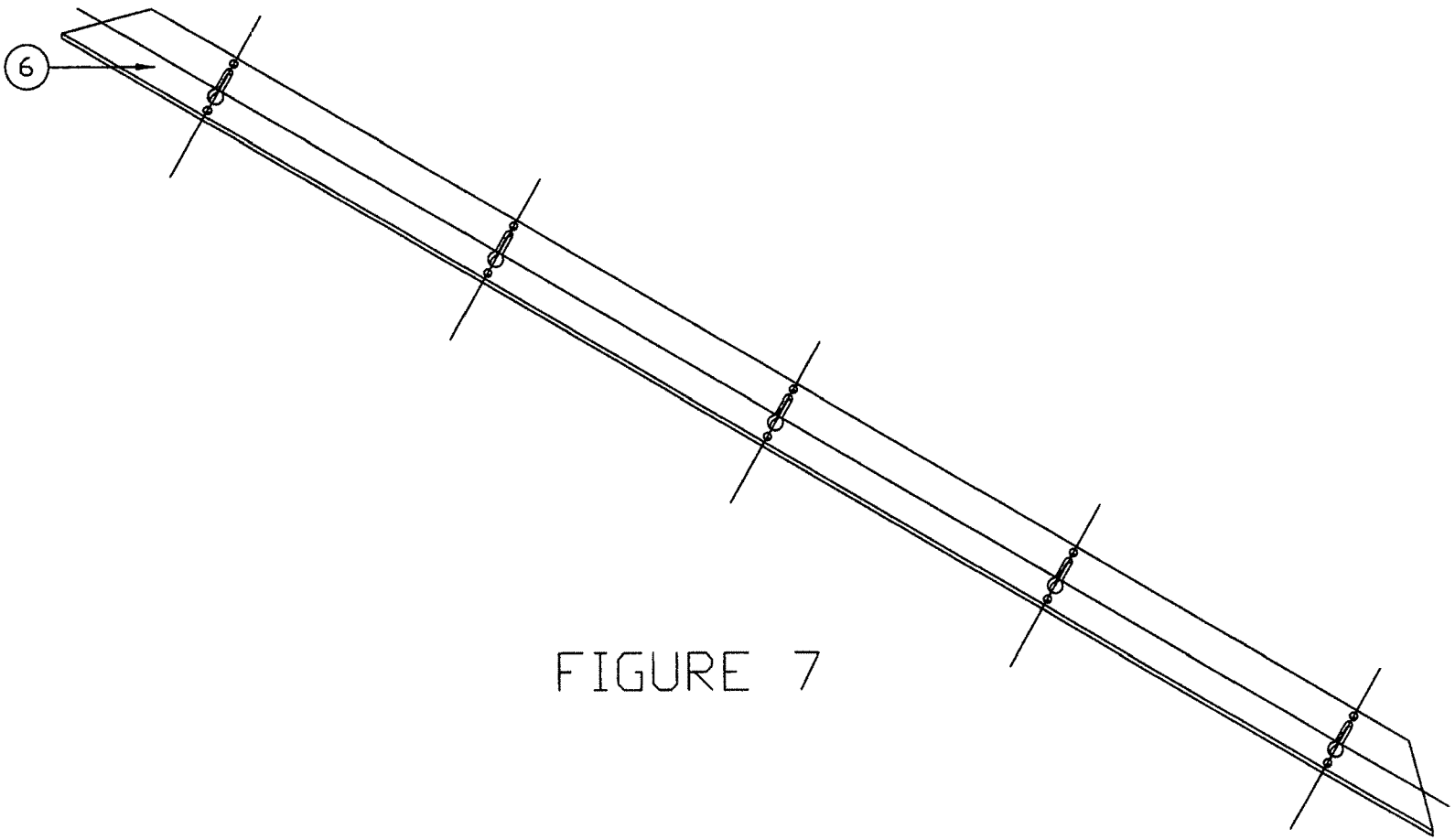

FIG. 7: This is a detailed, exploded view of Item 6, a Keyhole Strip to be utilized in lieu of Item 2 and for mounting the horizontal Trim pieces.

Figure 8:
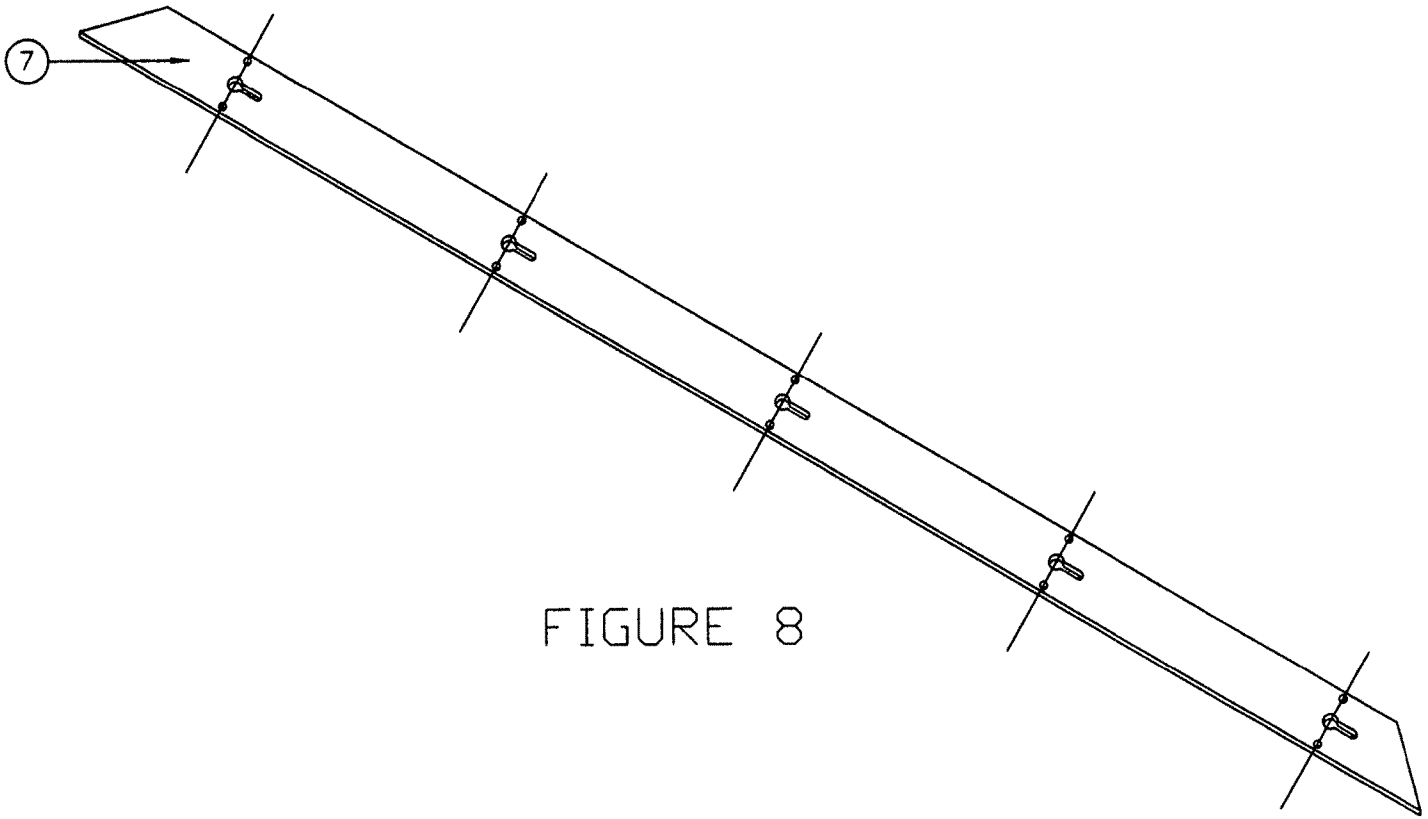

FIG. 8: This is a detailed, exploded view of Item 7, a Keyhole Strip to be utilized in lieu of Item 2 and for mounting the vertical Trim pieces.

Figure 9:
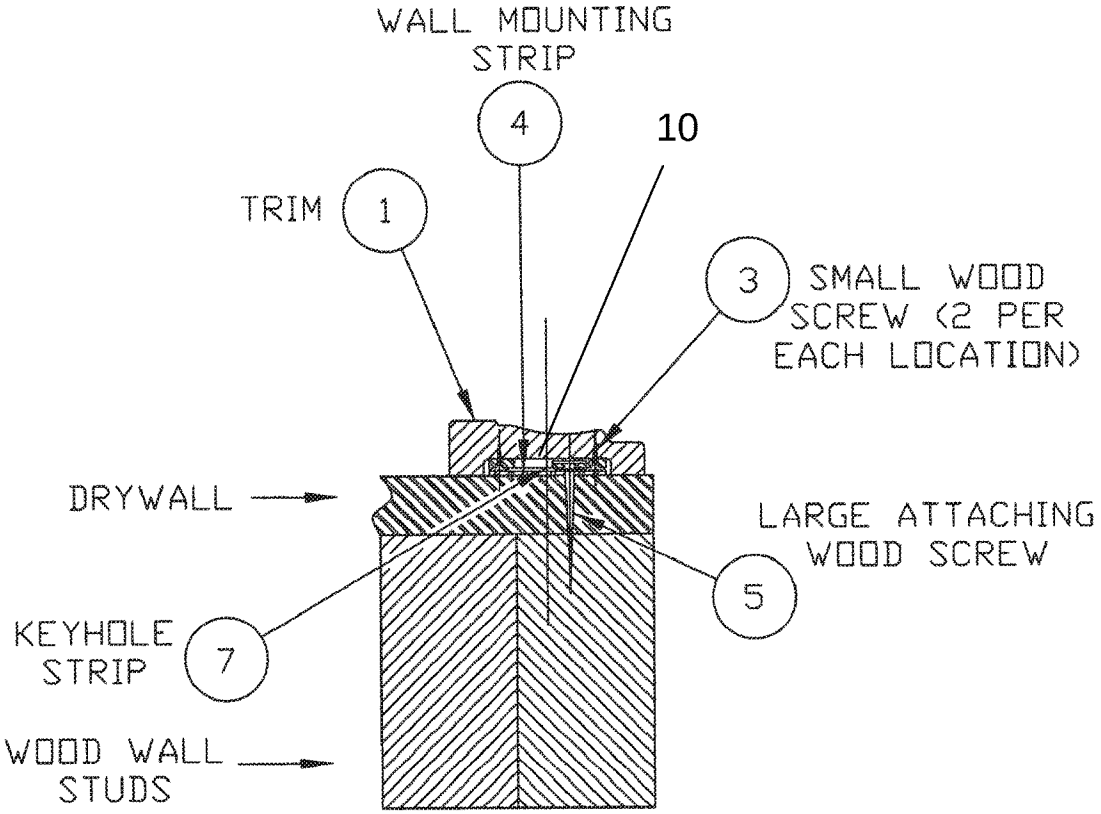

FIG. 9: A section view of the assembly with the components in their proper positions and identified with their Bill-of-Material item numbers. Also identified are the building drywall and wood wall studs for position clarity.

DETAILED DESCRIPTION OF THE INVENTION

The following detailed description is not to be misunderstood as a limiting factor but used as a purpose for illustrating the invention's general principles. This description is thought to be most accurate to describe the invention's advantages and simplicity when compared to all existing options for attaching and removing trim to and from a new or existing building surface.

As shown, Item 1 is the Trim, Item 2 is the Keyhole Clip, and Items 3 are the Small Wood Screws that attach the Keyhole Clip to the underside of the Trim. Methods other than screws for attaching the clip to the underside of the Trim are also available. Items 4 is the Foundation Strip, available in various materials. Item 5 is the Large Screw for attaching the Foundation Strip to the wall. Item 6 is a Keyhole Strip and attachment is the same as for the Keyhole Clip, Item 2. Instead of individual clips, the strip functions identically with fewer parts. Item 7 is the Side Trim Mounting Strip utilized for sliding side trim vertically.

This quick release system for the trim reduces time, materials, and effort when a building is under initial construction or renovation of an existing building as applied to, but not limited to, the trim, walls, ceilings and along the base of walls at the intersection of flooring. Conventional methods used today are permanent and especially difficult and messy when the building owner wishes to remodel or simply re-paint walls and ceilings. The embodiment of this invention provides and easy, clean method for attaching and removal of said trim for renovation or any and all other reasons. And, it is without the current issues with the trim and mating surfaces such as damaged or destroyed trim and mating surfaces. Included as part of this invention is the following trim ideas: with this invention, the trim can now be applied with a seasonal flare, the standard trim can easily be removed and replaced with a Thanksgiving, Christmas with embedded lighting for around windows and doors on interior trim, birthday—for boys or girls, Easter, or even trim out a room to a child's preference and more. For example: automobiles, trains, or dolls. This can be done with both new installations or remodeling an existing building.

This system has a single strip Item 4, attached to a building surface, such as a wall, utilizing the Large Attaching Wood Screws to secure the strip. These screws are positioned to allow the engagement into the wall studs, not just drywall. In this manner, once the strip, Item 4, is attached to the building's surface, no tools, standard or special, are required to remove or re-attach the trim.

Each strip has a screw or rivet head clearance hole spaced at eight (8) inch intervals, independent of the building's wall stud spacing. The trim mounting hardware is designed to accommodate the eight inch spacing. This eight inch spacing allows for buildings with various stud spacing and holds the trim significantly tight to the building's surface.

FIG. 9 shows the backside keyhole strip 7 mounted in a longitudinal slot 10 formed in the trim 1.

This design is such that the keyhole slot can be located on the underside of the trim or on the face of the mating surface. The keyhole slot attached to the underside of the trim will be offered as standard with the keyhole slot mounted to the mating surface offered if it is desired by a customer. When the customer purchases the trim, they have to make the choice of one or the other because it will come from the outlet ready to mount with minimum effort.

To properly position the trim, the only tools needed are a pencil, a tape measure, a straight edge, a level, and a standard Phillips screwdriver. For positioning the trim around other items such as windows and doors, dimensional information and instructions will be provided to ease the effort.

Item 5, the Large Attaching Wood Screws, will be provided with a shoulder to properly set the depth engaged into the wall. This provides the proper amount of screw head protruding from the wall for the trim to fit tightly, but not too tightly, against the wall and, the alignment of these screws is critical to the Trim's alignment to any associated surface. This shoulder also allows Item 4, the Foundation Strip, to be securely attached to the building surface. It also eliminates the guess work of screw head depth associated with screws without the shoulder. See FIG. 6 for a view of this screw. Dimensional data is not currently supplied.

Although the above focuses on simplification of attaching trim, or similar building materials, to building surfaces, this concept, with it's flexibility, may be expanded for other uses such as attaching pictures, wall décor, or other similar items.

Without departing from the above scope and spirit of this invention, modifications may be made for simplification, cost savings, and potentially any other issues that may arise. As set forth, the foregoing embodiment's of this invention include, but are not limited to, all the above claims. Upon release to the general public, instructions along with a pictorial view, as pictures and as a video, of how the components are to be attached and removed, will become available.

What is claimed is:

1. A building trim assembly for slidably attaching trim pieces to a building mounting surface of a building wall in a manner that permits the trim pieces to be slidably removed from the building mounting surface, the building trim assembly comprising:

(a) a first piece of trim, the trim being elongated in a longitudinal direction;

(b) a second piece of trim, the trim being elongated in a longitudinal direction;

(c) at least two wall mounting strips for attachment to a building surface, each wall mounting strip having multiple spaced apart screw clearance holes for receiving screw fasteners for attaching the wall mounting strips to the building surface, the spaced apart screw clearance holes being spaced apart by substantially six inches or eight inches and existing in the wall mounting strips when they are not attached to said building surface;

(d) a first elongated backside keyhole strip attached longitudinally along the first piece of trim, the first backside keyhole strip having a series of spaced apart keyhole slots aligned laterally across the said first elongated backside keyhole strip perpendicularly to the longest sides of said first backside keyhole strip and extending entirely through said first backside keyhole strip, the spacing of the keyhole slots being identical to the spacing of the screw clearance holes in the wall mounting strips;

(e) a second elongated backside keyhole strip attached longitudinally along the second piece of trim, the second backside keyhole strip having a series of spaced apart keyhole slots aligned longitudinally along said second elongated backside keyhole strip parallel to the longest sides of said second backside keyhole strip and extending entirely through said first backside keyhole strip, the spacing of the keyhole slots being identical to the spacing of the screw clearance holes in the wall mounting strips; and (f) a plurality of attaching wood screws for insertion through the screw clearance holes of the wall mounting strips and into the building wall to mount the wall mounting strips to the wall, the wood screws having a pair of spaced apart screw heads forming a shoulder configured to set the depth the screws are engaged in the building wall.

2. A building trim assembly according to claim 1 wherein the first piece of trim and the second piece of trim have longitudinal slots into which the backside strips are mounted.

3. A building trim assembly according to claim 1 and further comprising at least two additional said wall mounting strips, at least an additional said first elongated backside keyhole strip and at least an additional second elongated backside keyhole strip.

* * * * *